US006779446B2

(12) United States Patent
Hajek et al.

(10) Patent No.: US 6,779,446 B2
(45) Date of Patent: Aug. 24, 2004

(54) OFFSET PRINTING MACHINE

(75) Inventors: Josef Hajek, Friedberg (DE); Johann Königer, Augsburg (DE); Michael Schramm, Ainding (DE); Peter Gröbner, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/636,338

(22) Filed: Aug. 6, 2003

(65) Prior Publication Data

US 2004/0025724 A1 Feb. 12, 2004

Related U.S. Application Data

(62) Division of application No. 09/657,509, filed on Sep. 7, 2000, now Pat. No. 6,644,184, which is a division of application No. 08/386,371, filed on Feb. 9, 1995, now Pat. No. 6,408,748.

(30) Foreign Application Priority Data

Aug. 30, 1994 (DE) ..... 44 30 693

(51) Int. Cl.[7] ..... B41F 5/00; B65H 45/16

(52) U.S. Cl. ..... 101/216; 101/219; 493/359; 493/429; 493/424

(58) Field of Search ..... 101/483, 177, 101/181, 216, 219, 226, 248; 493/415, 424, 429, 359

(56) References Cited

U.S. PATENT DOCUMENTS

| | | | | |
|---|---|---|---|---|
| 3,557,692 A | | 1/1971 | Lee | |
| 4,495,582 A | | 1/1985 | Dessert | |
| 5,106,358 A | * | 4/1992 | Meschi | 493/415 |
| 5,242,367 A | * | 9/1993 | Marmin | 493/359 |
| 5,309,834 A | | 5/1994 | Koch | |
| 5,656,909 A | | 8/1997 | Gotz et al. | 318/625 |
| 5,836,245 A | | 11/1998 | Bolza-Schünemann | 101/181 |

FOREIGN PATENT DOCUMENTS

| | | |
|---|---|---|
| DE | OS 2 046 131 | 3/1972 |
| DE | 2046131 | 3/1972 |
| DE | 20 46 131 | 3/1972 |
| DE | 7046973 | 11/1973 |
| DE | 2341510 | 4/1974 |
| DE | 2336061 | 2/1975 |
| DE | 2604623 | 8/1977 |

(List continued on next page.)

OTHER PUBLICATIONS

Hackel, Ingo; Zimmermann, Horst; Modulpac C, ein System zum Regln . . . ; Siemens–Zeitschrift 52 (1978) H4, pp. 209–212.

Siebert, Jurgen; "Simadyn D, ein schnelles digitales Regel. und Steuersystem"; Siemmens Energie & Automation 8 (1986) A. 2. pp. 112–123.

"Metomotorenantrieb fur Rotationsdruckmaschinen"; Siemens Zeitschrift 51. Jg. H. 5 May 1997, pp. 1–8.

Mierke, Wilfried, et al.; "Zentralantried oder Einzelmotoren?" Des Polygraph 18–91 p. 1448.

Patents Abstracts of Japan, M–1446, Jul. 15, 1993. vol. 17/No. 377; 5–64882.

Patents Abstracts of Japan, M–68, May 14, 1981, vol. 5/No. 72; 56–21860.

(List continued on next page.)

*Primary Examiner*—Eugene H. Eickholt
(74) *Attorney, Agent, or Firm*—Cohen, Pontani, Lieberman & Pavane

(57) ABSTRACT

The invention relates to the drive of a printing machine. Cylinders and functional groups are to be driven with low technical expenditure. To this end, all form cylinders (1.1, 1.2)in a printing unit, for example, are driven respectively by separate electric motors (7) and are not in mechanical drive connection.

6 Claims, 17 Drawing Sheets

FOREIGN PATENT DOCUMENTS

| | | | |
|---|---|---|---|
| DE | 2924616 | 1/1981 | |
| DE | 31 36 704 A1 | 3/1983 | |
| DE | 34 35 487 A1 | 4/1985 | |
| DE | 3407428 | 10/1985 | |
| DE | 3602894 | 8/1987 | |
| DE | 3614979 | 11/1987 | |
| DE | 3715536 | 12/1988 | |
| DE | 39155482 | 11/1990 | |
| DE | 4127331 | 2/1993 | |
| DE | 41 38 479 | 6/1993 | |
| DE | 4138479 | 6/1993 | |
| DE | 4202722 | 8/1993 | |
| DE | 42 14 394 A1 | 11/1993 | |
| DE | 42 15 227 A1 | 11/1993 | |
| DE | 4215227 | 11/1993 | |
| DE | 42 19 969 | 12/1993 | ..... B41F/13/00 |
| DE | 9306369 | 12/1993 | |
| DE | 4234308 | 4/1994 | |
| DE | 4234331 | 4/1994 | |
| DE | 4332364 | 4/1994 | |
| DE | 4241807 | 6/1994 | |
| EP | 0 363 803 | 4/1990 | |
| EP | 567 741 | 11/1993 | |
| EP | 644 048 | 3/1995 | |
| GB | 2 149 149 A | 6/1985 | |
| GB | 2 261 629 | 5/1993 | |
| JP | 59-87157 | 5/1984 | |
| JP | 63 23 6651 | 3/1988 | |
| JP | 63 236 651 | 3/1988 | |
| JP | 63-13005 | 4/1988 | |
| JP | 63-264355 | 11/1988 | |
| JP | 64-82947 | 3/1989 | |
| JP | 2-24937 | 2/1990 | |
| JP | 03-205152 | 9/1991 | |
| JP | 4-232744 | 8/1992 | |
| JP | 5-4333 | 1/1993 | |
| JP | 5-16336 | 1/1993 | |
| JP | 6-134959 | 5/1994 | |
| WO | 9400297 | 1/1994 | |

OTHER PUBLICATIONS

Ariticle entitled "Rotationsmaschinenantrieb ohne Längswelle—eine Wiederentdeckung von Hamada" from Zeitungstechnik dated Dec. 1991, pp. 78–80.

Disektantriebstechnik, Baumüller Nürnberg Gmbh, Apr. 1993 (with translation).

"Mehr Motorenantrieb fuer Rotationsdruckmaschinen" by Siegfried Meyer and Ernst Sondermann, Siemens—Zeitschrift 51 (1977), No. 5, pp. 387–395.

"Der Rollenoffsetdruck" by Wolfgang Walenski, Geschichte Moderne Technik Materialien, Fachschriftenverlag GmbH & Co. KG, 1995, pp. 146–147 and 244–247.

* cited by examiner

OFFSET PRINTING MACHINE

CROSS-REFERENCE TO RELATED APPLICATION(S)

This application is a division of Ser. No. 09/657,509 filed Sep. 7, 2000 and now U.S. Pat. No. 6,644,184 which was a division of Ser. No. 08/386,371 filed Feb. 9, 1995 and now U.S. Pat. No. 6,408,748.

BACKGROUND OF THE INVENTION

1. Field of the Invention

The present invention relates to offset printing machines and. more particularly, to drives and driving processes for cylinders and functional groups of offset printing machines.

2. Description of the Prior Art

German Patent No. DE 42 19 969 A1 describes an offset printing machine having a longitudinal shaft which is driven by one or more electric motors. Drive shafts, which are used to drive the printing units, unwinders, folder units and functional groups, e.g., feeding and transfer rollers, forming rollers, cutting rollers, and cooling mechanisms, in such printing machines branch off from the longitudinal shaft via gears and couplings. The gears usually contain further couplings and gearwheels. These drives are therefore technically complex and expensive.

SUMMARY OF THE INVENTION

The present invention is based on creating simplified and less expensive processes and driven for driving cylinders and functional groups for offset printing machines.

The individual motor drive of the present invention makes it possible to dispense with shafts, gears, couplings and gearwheels. In addition, electrical monitoring devices for the aforementioned components are dispensed with as well.

Further advantages and features of the present invention will become apparent when taken in conjunction with the following description.

BRIEF DESCRIPTION OF THE DRAWINGS

The invention is described in greater detail below with reference to several examples. The accompanying drawings in which like reference numerals denote similar elements throughout the several views show.

DETAILED DESCRIPTION OF THE PREFERRED EMBODIMENTS

Figure 1:
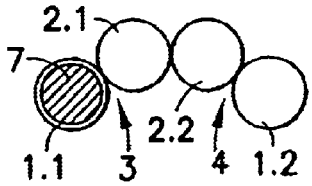
FIG. 1 is a schematic side view of a first embodiment of a printing unit in accordance with the present invention.

FIGS. 1 to 4 show individual printing units, each printing unit is driven by a separate, angle-controlled electric motor. In FIG. 1, the printing unit contains two printing groups 3, 4. Each printing group 3. 4 includes a form cylinder 1.1, 1.2 and a transfer cylinder 2.1, 2.2. Each form cylinder 1.1., 1.2 and each transfer cylinder 1.1, 1.2, 2.1, 2.2 includes journals 154, 156; 158, 160; 162, 164; and 166, 168, respectively, on both sides thereof and is mounted by its journals in side walls 5, 6. The mounting of the form cylinders 1.1., 1.2 and the transfer cylinders 2.1., 2.2 of FIG. 1, is shown in FIG. 5. An angle-controlled electric motor 7, which drives the form cylinder 1.1, is arranged on the operator-side wall 5. The design of this drive connection will be discussed below. The journals 156, 160, 164, 168 mounted in the side wall 6, each carry a the respective spur gears gear 8 to 11. The cylinders 1.1, 1.2, 2.1, 2.2 are coupled together through the spur gears 8, 9, 10, 11 and are in drive connection with each other In this way, all four cylinders 1.1., 1.2., 2.1 and 2.2 are driven by the electric motor 7 through their connection to the form cylinder 1.1 of the first printing group 3. The electric motor 7 is represented in FIGS. 1–4 by hatching.

Figure 2:
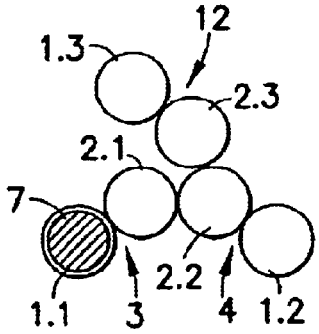
FIG. 2 is a schematic side view of a second embodiment of a printing unit in accordance with the present invention.

In FIG. 2, the printing unit shown in FIG. 1 is supplemented by the printing group 12 which includes a form cylinder 1.3 and a transfer cylinder 2.3. The printing group 12 is set on the printing group 4, whereby the drive-side journals of the printing group 12 also carry spur gears (not shown) and the spur gear of the transfer cylinder 2.3 engages with the spur gear 11 of the transfer cylinder 2.2 so the printing groups 4 and 12 are in drive connection with each other.

Via these spur gears, 8 to 11, all the form and transfer cylinders are in drive connection with the form cylinder 1.1, and thus are driven by the electric motor 7.

Figure 3:
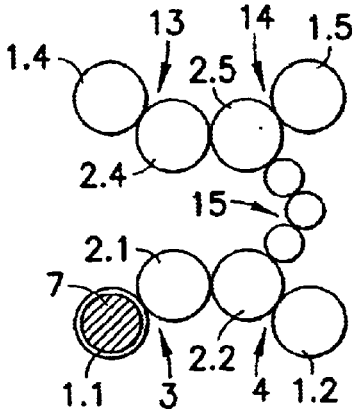
FIG. 3 is a schematic side view of a third embodiment of a printing unit in accordance of the present invention.

In FIG. 3, the printing groups 3, 4 as in FIG. 1, are supplemented by two coupled printing groups 13, 14. Each printing group 13, 14 includes a form cylinder 1.4, 1.5 and a transfer cylinder 2.4, 2.5. Each of these cylinders 1.4, 1.5, 2.4, 2.5 include journals on either side. The drive-side journal of each of the cylinders 1.4, 1.5, 2.4, 2.5 carries a spur gear (not shown), through which the cylinders are interactively engaged. Furthermore, the spur gear 11 of the transfer cylinder 2.2 is in drive connection, via a gear chain 15 with the spur gear (not shown) of the transfer cylinder 2.5, and thus is also in drive connection with the form cylinder 1.1, so that all of the cylinders are driven by the electric motor 7.

Figure 4:
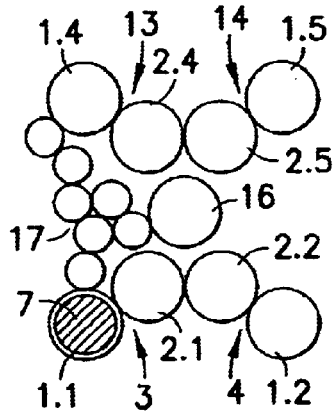
FIG. 4 is a schematic side view of a fourth embodiment of a printing unit in accordance with the present invention.
Figure 5:
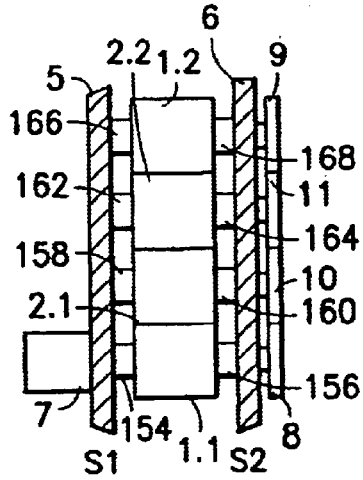
FIG. 5 is a top view partly in section of the printing unit of FIG. 1.

In contrast to FIG. 3, the printing unit in FIG. 4 includes a satellite cylinder 16. The satellite cylinder 16 also includes journals on either side thereof and carries a spur gear (not shown) on the drive-side journal. This spur gear, as well as the spur gear of the form cylinder 1.4 of the printing group 13, is driven by a gear chain 17. The gear chain 17 is also coupled to and in drive connection with the spur gear 8 of the form cylinder 1. Thus all cylinders of the printing unit are coupled together and driven by the electric motor 7.

Figure 6:
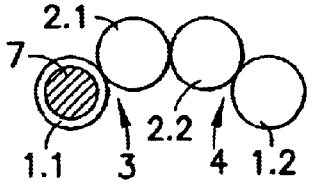
FIG. 6 is a schematic side view of a first embodiment of a printing group bridge with a drive in accordance with the present invention.
Figure 7:
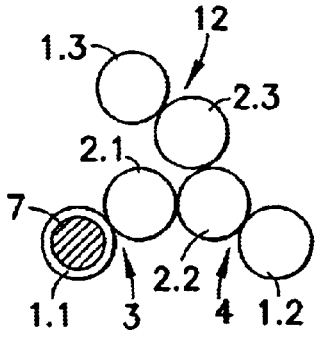
FIG. 7 is a schematic side view of a second embodiment of a printing group bridge with a drive in accordance with the present invention.
Figure 10:
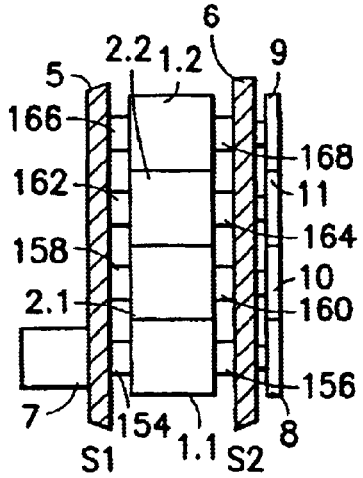
FIG. 10 is a top view partly in section of the printing group bridge of FIG. 6.

FIGS. 6, 7 and 10 show bridges, i.e., parts of printing units, which correspond to the printing units shown in FIGS. 1, 2 and 5 respectively and are therefore not described again in detail.

Figure 8:
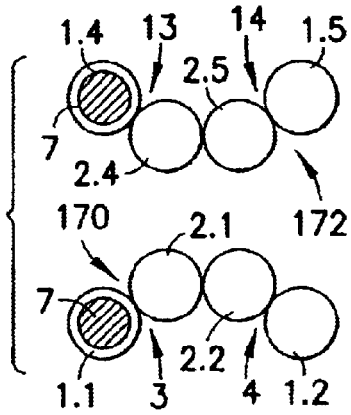
FIG. 8 is a schematic side view of a third embodiment of a printing group bridge with a drive in accordance with the present invention.

In FIG. 8, the gear chain 15 shown in FIG. 3 is omitted. The lower printing group bridge 170 (double printing group), includes the form cylinders 1.1 and 1.2 and the transfer cylinders 2.1 and 2.2. The lower printing group bridge 170 is driven in the same manner as in FIGS. 6 and 7 by the angle controlled electric motor 7. The upper printing group bridge 172 includes form cylinders 1.4, 1.5 and transfer cylinders 2.4, 2.5. The upper printing group bridge 172 is also driven by an angle-controlled electric motor 7, which acts upon the form cylinder 1.4. The angle-controlled electric motor 7 is shown by hatching in FIGS. 6–9. The angle-controlled electric motor 7 acts, through the form cylinder 1.4, to drive the spur gears (not shown) on the journals of the cylinders 1.4, 2.4, 2.5, 1.5.

Figure 9:
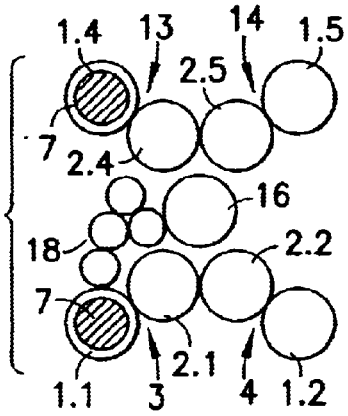
FIG. 9 is a schematic side view of a fourth embodiment of a printing group bridge with a drive in accordance with the present invention.

In FIG. 9, the situation is similar to that of FIG. 8. The only difference is that a satellite cylinder 16 is indirectly connected to the form cylinder 1.1 of printing group 3. The satellite cylinder 16 is thus also driven by the electric motor 7 attached to the form cylinder 1.1 through the gear chain 18. Printing group bridges of the types shown in FIGS. 6 to 9, or of different types, may be combined into various printing units. The embodiments described below with respect to FIGS. 11–14 and 16–19 can tee also be used.

In the above examples, it is also possible for each or all of the form cylinders transfer cylinders, or satellite cylinders, to be directly driven by an electric motor. The electric motor does not necessarily need to be connected to the form cylinder as described above.

Figure 11:
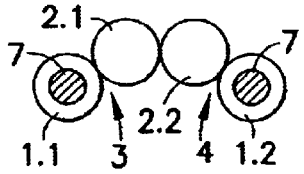
FIG. 11 is a schematic side view of a first embodiment of a printing group bridge having a drive for each printing group in accordance with the present invention.
Figure 12:
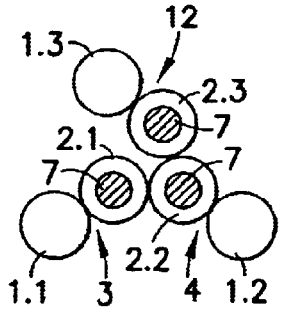
FIG. 12 is a schematic side view of a second embodiment of a printing group bridge having a drive for each printing group in accordance with the present invention.

The double printing group shown in FIG. 11 contains the printing groups 3, 4. These printing groups are identical to those in FIG. 1. Each printing group 3. 4 includes respective form cylinders 1.1, 1.2 and transfer cylinders 2.1, 2.2. These cylinders are also mounted through their respective journals 154, 156; 158, 160; 162, 164; and 166, 168 in side walls 5, 6 (FIG. 15), as in FIGS. 1 and 6. However, each printing group 3, 4 is driven by its own angle-controlled electric motor 7. More specifically, the form cylinders 1.1 and 1.2 of each printing group are connected to and driven by a respective angle-controlled electric motor 7. The angle-controlled electric motors 7 are shown by hatching in FIGS. 11–14 and can be more clearly seen in FIG. 15. The drive-side journals of the form cylinders 1.1, 1.2 carry the respective spur gears 8, 19, which mesh with the respective spur gears 10, 20 on the journals of the transfer cylinders 2.1, 2.2 as can be seen in FIG. 15. The spur gears 8, 10 and 19, 20 lie in two different planes, since the transfer cylinders 2.1, 2.2 are not permitted to be in drive connection with one another. The An angle-controlled electric motors 7 act upon the respective operator-side journals, 154, 166 of each of the form cylinders 1.1, 1.2 and thus the printing groups 3, 4 are individually driven.

In the previous examples and in those that follow, the electric motors drive the form cylinders. However, it is also possible for the transfer cylinders to be driven by the electric motors. For example, in the printing unit shown in FIG. 12, the electric motors 7 drive the respective transfer cylinders 2.1, 2.2, 2.3 of the printing groups 3, 4, 12. These transfer cylinders then drive their respective associated form cylinders 1.1, 1.2, 1.3 through associated and interengaging spur gears. As in FIG. 15, the spur gears 19, 20 of the printing group 4 and the spur gears 8, 9 of printing group 3 are not permitted to lie on the same plane. Likewise, the spur gears of the printing group 4 and the spur gears of the printing group 12 are not permitted to lie on the same plane. The spur gears of printing group 12 are not shown in FIG. 15.

Figure 13:
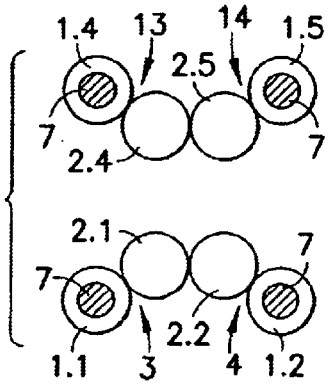
FIG. 13 is a schematic side view of a third embodiment of a printing group bridge having a drive for each printing group in accordance with the present invention.

In the printing unit in FIG. 13, each of the form cylinders 1.1, 1.2, 1.4, 1.5 of the printing groups 3, 4, 13, 14 is driven by an angle-controlled electric motor 7. These form cylinders then drive the respective associated transfer cylinders 2.1, 2.2, 2.4, 2.5 through associated and interengaging spur gears. The respective spur gears of coupled printing groups, i.e. the spur gears of printing groups 3 and 4 and the spur gears of printing groups 13 and 14, lie on two different planes.

Figure 14:
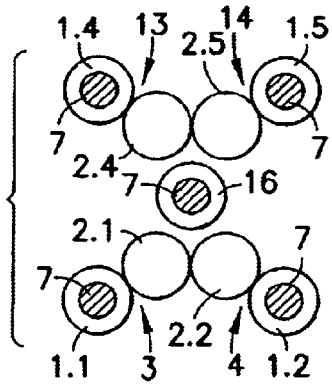
FIG. 14 is a schematic side view of a fourth embodiment of a printing group bridge having a drive for each printing group in accordance with the present invention.
Figure 15:
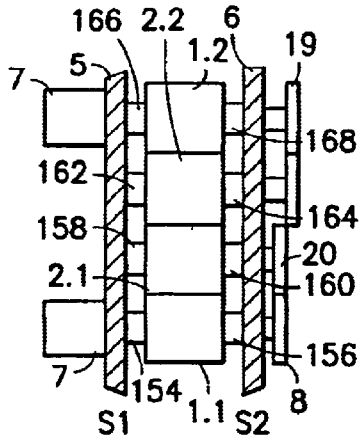
FIG. 15 is a top view partly in section of the printing croup bridge of FIG. 11.
Figure 16:
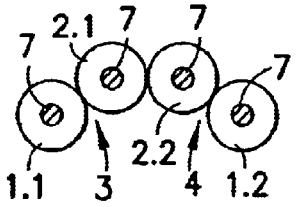
FIG. 16 is a schematic side view of a first embodiment of a printing group bridge having a drive for each cylinder in accordance with the present invention.
Figure 17:
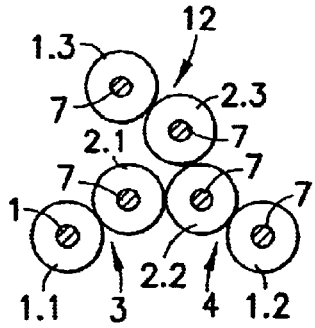
FIG. 17 is a schematic side view of a second embodiment of a printing group bridge having a drive for each cylinder in accordance with the present invention.
Figure 18:
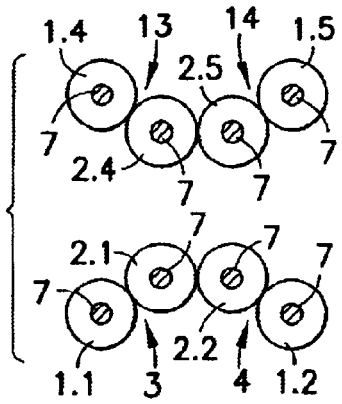
FIG. 18 is a schematic side view of a third embodiment of a printing group bridge having a drive for each cylinder in accordance with the present invention.
Figure 19:
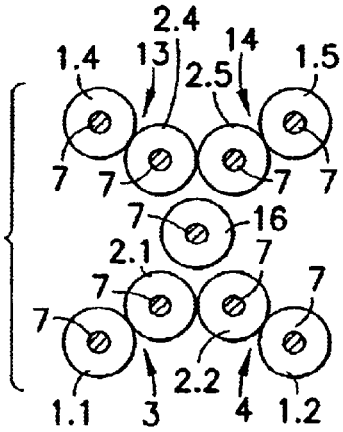
FIG. 19 is a schematic side view of a fourth embodiment of a printing group bridge having a drive for each cylinder in accordance with the present invention.

In FIG. 14, the printing groups 3, 4, 13, 14 are driven analogously to FIG. 13. In addition, the satellite cylinder 16 is also driven by a separate, angle-controlled electric motor 7.

Figure 20:
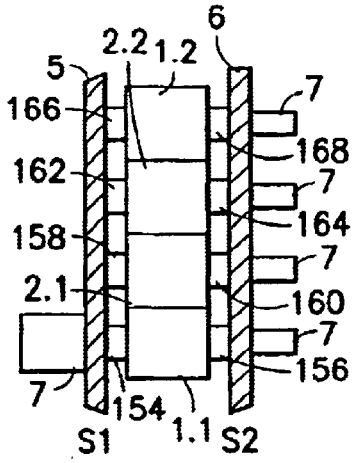
FIG. 20 is a top view partly in section of the printing group bridge of FIG. 16.

In the printing units in FIGS. 16 to 19, each form cylinder 1.1 to 1.5, each transfer cylinder 2.1 to 2.5 and the satellite cylinder 16, if present, is driven by a separate, angle-controlled electric motor 7. As in the previous examples, each of the cylinders have respective journals and are mounted in the side walls 5, 6 by these journals. In contrast to the previous examples, however, the respective electric motors 7 are coupled to the journals on the "drive side" S2 or side wall 6 as is shown in FIG. 20 representing a side view of the embodiment of FIG. 16. The electric motors 7 could also be coupled to the journals on the operator-side S1 or side wall 5. Furthermore, in the prior examples shown in FIGS. 1–15, the electric motors 7 could have been coupled to the journals on the drive-side. When each printing group is equipped with its own drive motor, as shown in FIGS. 11–14, the individual printing groups can each be individually adjusted and properly aligned When each cylinder is driven individually, it is even possible to individually align and adjust the form cylinder and transfer cylinder of a single printing group. Such embodiments are shown in FIGS. 16–19. In addition, all toothed-wheel gears are dispensed with, as are the lubrication, housings, etc., usually required for such gears as the drive motors are capable of performing their functions. This results in a tremendous reduction in price. In addition, mechanical (and electrical) devices for the desired printing group control are no longer needed as the functions of these devices are performed by reversing the rotational direction of the drive motors.

In the examples described, a printing group always includes a form cylinder and a transfer cylinder. Each printing group works together with at least one other printing group and/or a satellite cylinder according to the principle of blanket-to-blanket printing principle. The printing groups described above with reference to FIGS. 1–20 can also be enlarged by a counter-impression cylinder into a three-cylinder printing group, whereby at least one cylinder is driven by a separate electric motor and the three cylinders are connected so as to drive each other through toothed gears.

The angle control of the electric motors is performed by computer motor controls within the framework of the machine control system. Accordingly, the electric motors are connected to the machine control system. However, the controls are not part of the subject matter of the invention and are therefore not depicted or explained herein.

Figure 21A:
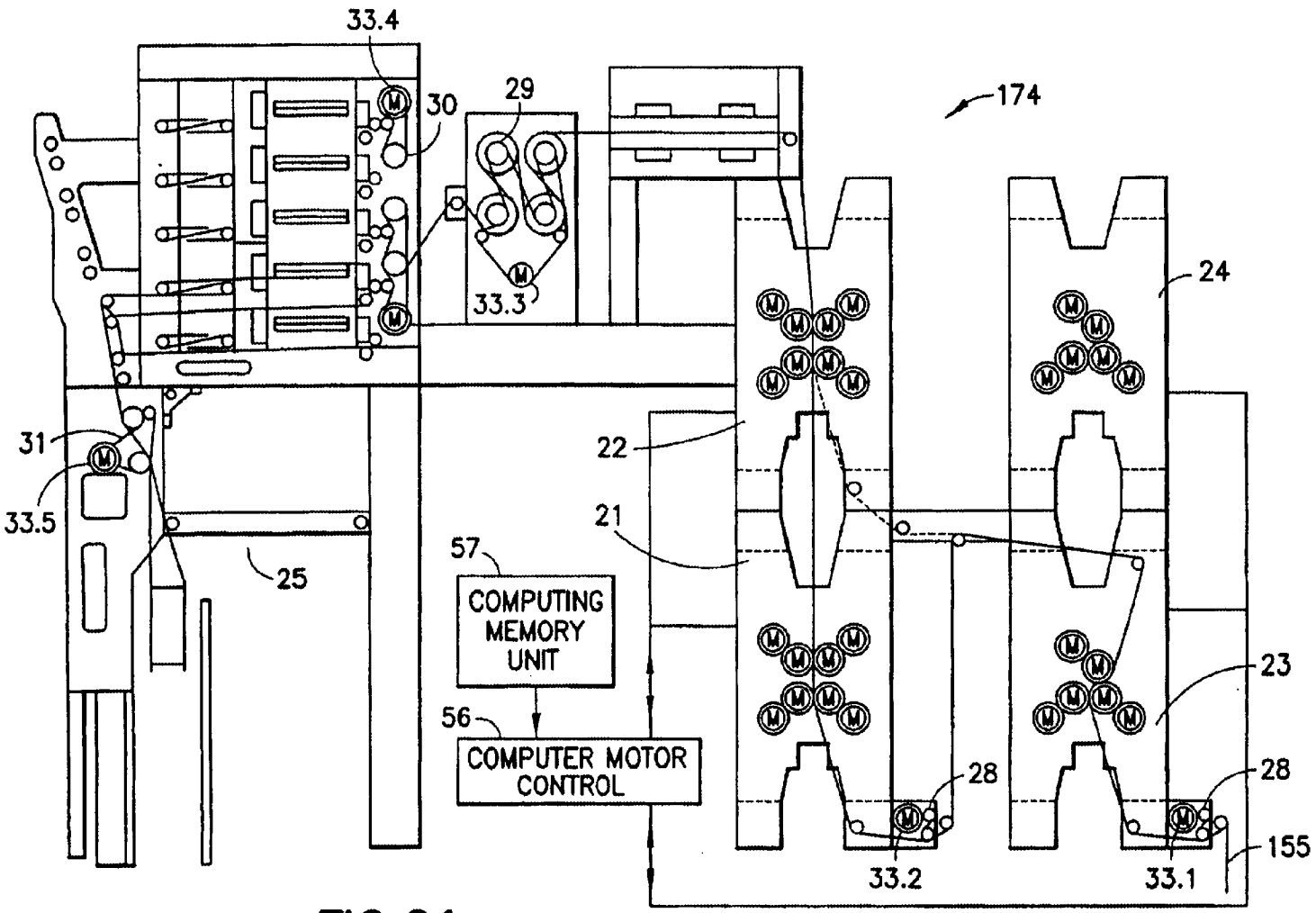
FIG. 21*a* is a side view partly in cross section and partly in elevation of a first printing machine having functional groups.
Figure 21B:
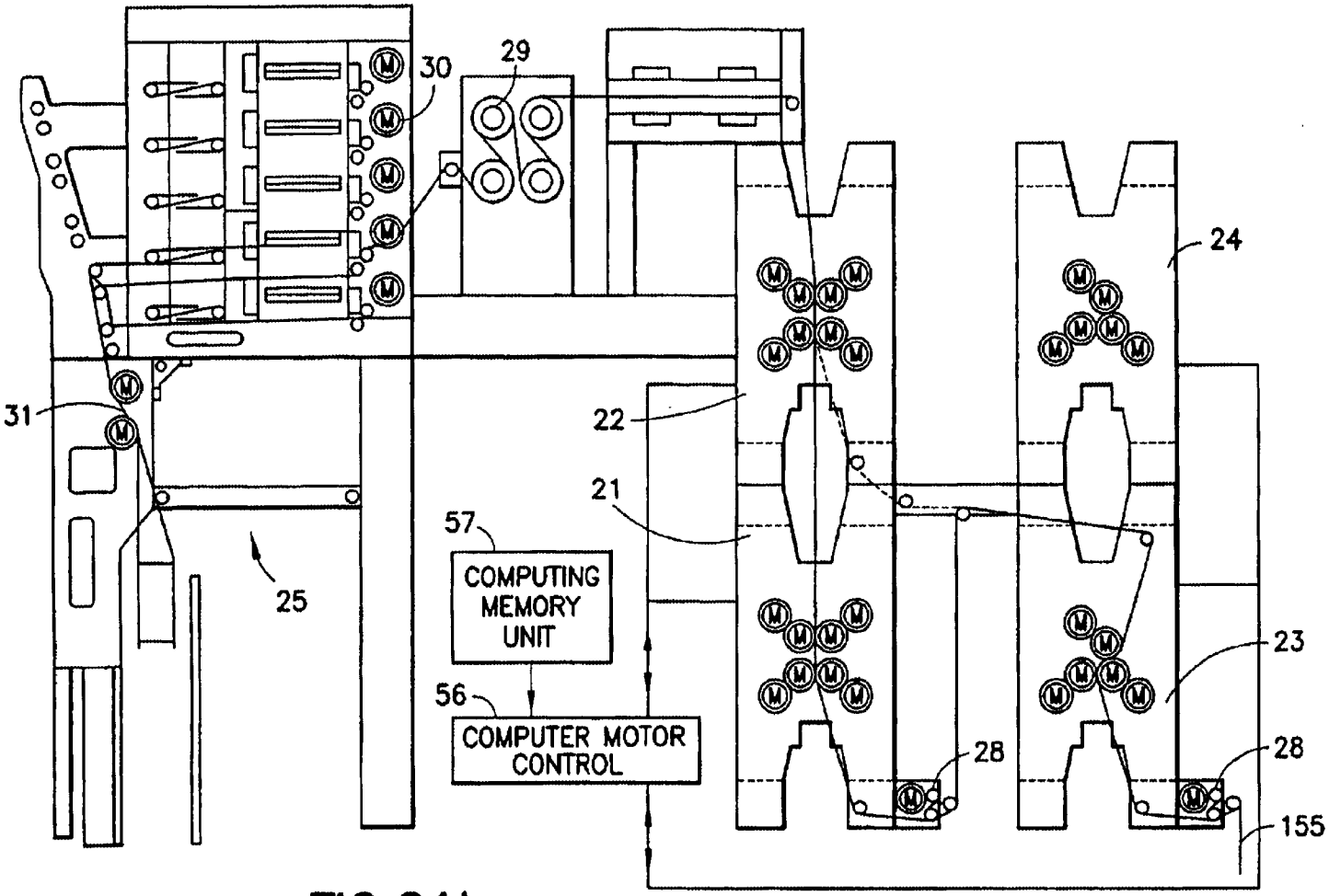
FIG. 21*b* is a side view partly in cross section and partly in elevation of a second printing machine having functional groups.
Figure 22A:
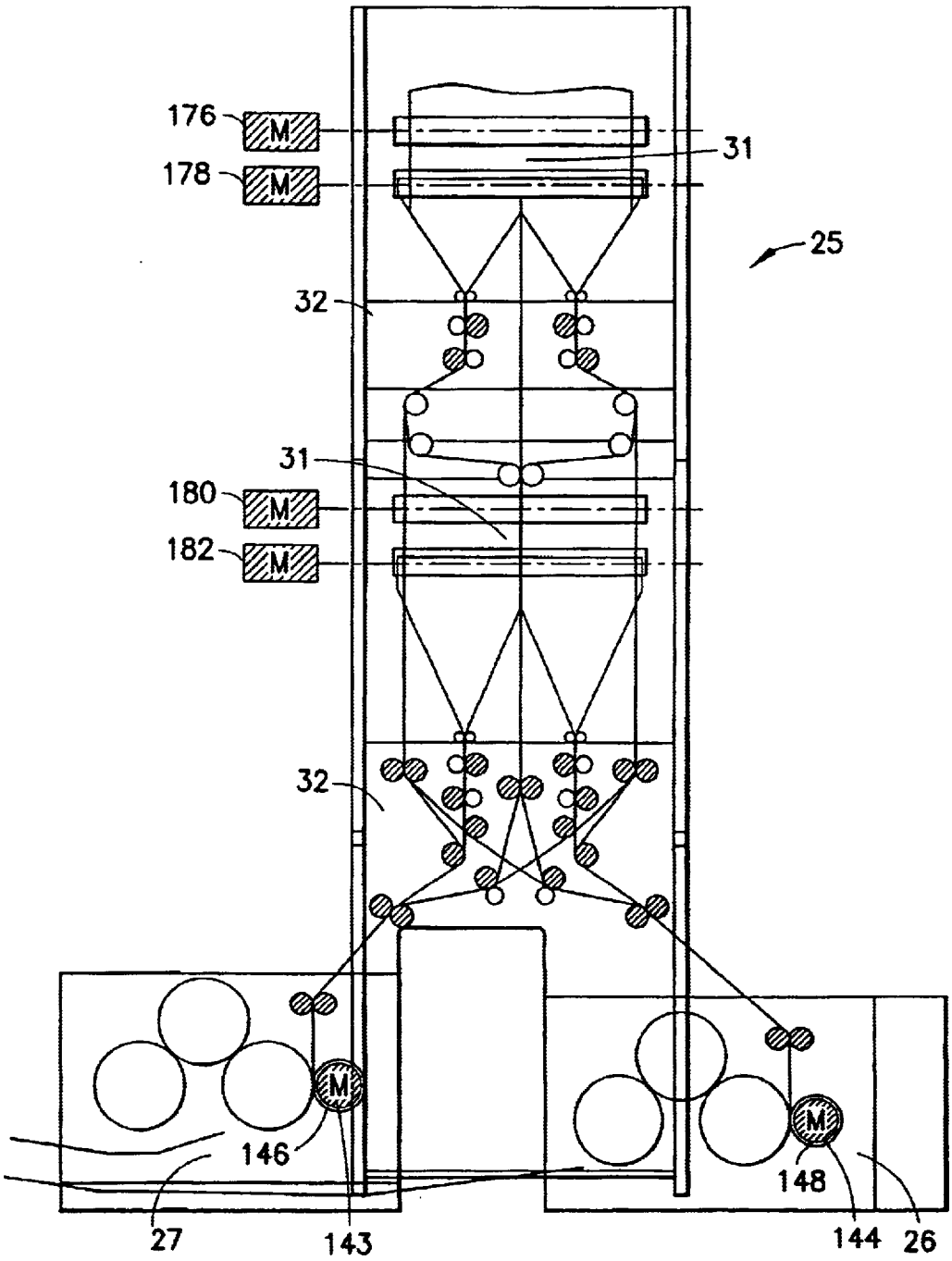
FIG. 22*a* is a side view partly in cross section and partly in elevation of a first folder unit having functional groups.

Further functional groups of printing machines such as webbing-in mechanisms, cooling rollers, cutting rollers and forming rollers can also be advantageously driven with separate electric motors. FIG. 21*a* shows a side view of a printing machine 174 and FIG. 22*a* shows a folder unit 25 including functional groups of the type mentioned above. The printing machine 174 in FIG. 21*a* contains four printing units 21 to 24 and a folder unit 25. With respect to drive, the printing units 23 and 24 resemble the printing unit shown in FIG. 17, while the printing units 21 and 22 resemble those shown in FIG. 18. The drive motors of the cylinders, like those of the functional groups described below, are each identified by an "M" or with hatching. The folder unit 25 shown in FIG. 22*a* contains the folding mechanisms 26 and 27. In FIG. 21*a*, the webbing-in mechanisms 28, the cooling rollers 29, the cutting rollers 30 and the forming rollers 31 are each drive by respective separate, angle-controlled electric motors 33.1 to 33.5. These electric motors 33.1, 33.2, 33.3, 33.4, 33.5 thereby drive the cylinders of the webbing-in mechanisms 28, the cooling rollers 29, the cutting rollers 30 and the forming rollers 31, respectively, indirectly via belts. FIG. 21*b* shows the same printing machine, with each cylinder being driven directly by a motor.

In FIG. 22*a*, the forming rollers 31 and the feeding and transfer rollers 32, respectively, are each driven directly by separate, angle-controlled electric motors 176, 178, 180, 182. The two folding mechanisms 26 and 27, respectively, also have separate, angle-controlled motors 143, 144, which directly drive the respective folding cylinders, in this case, the knife cylinders 146, 148. The knife cylinders 146. 148 each have journals and spur gears connected thereto. The other folding cylinders which also include journals and spur gears are each engaged with a respective knife cylinder via the spur gears (not shown) arranged on their journals.

Figure 22B:
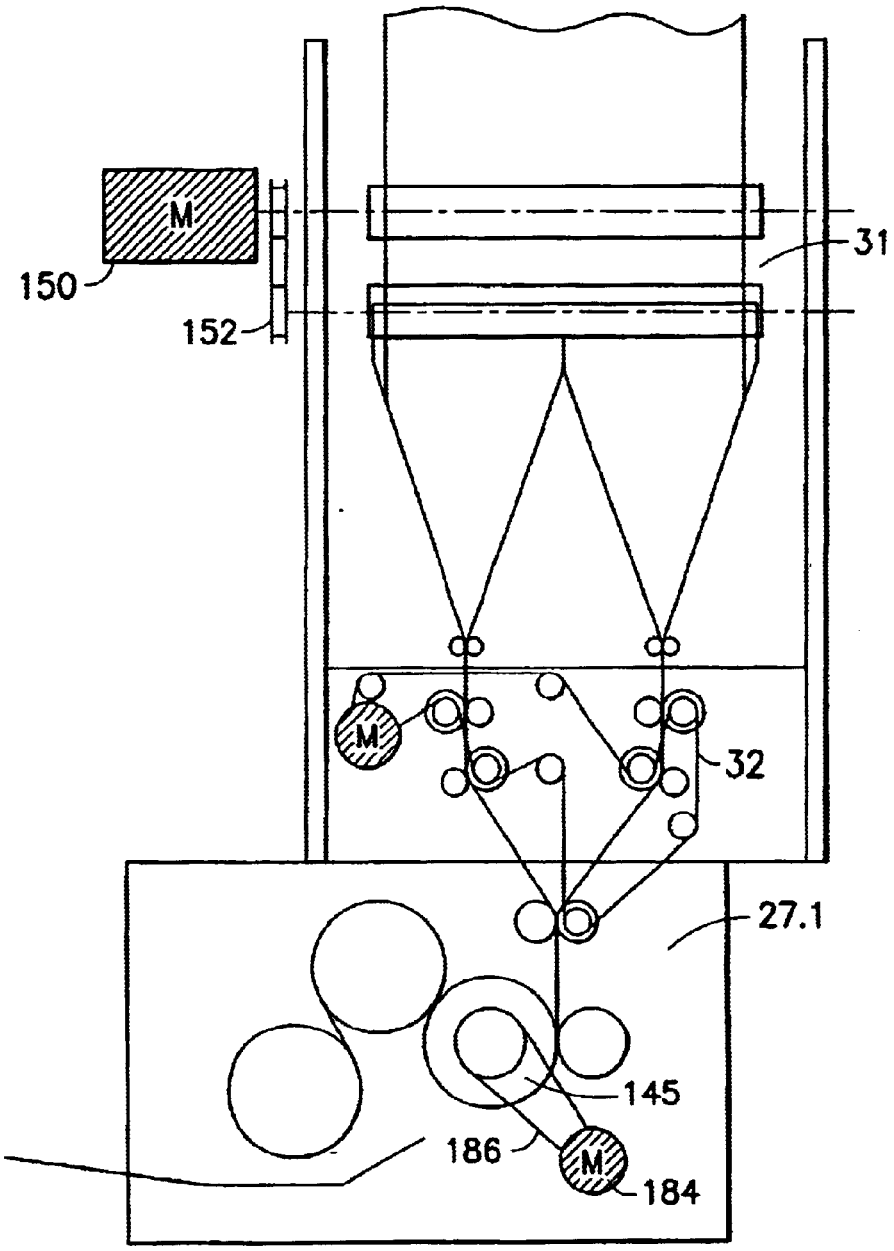
FIG. 22*b* is a side view partly in cross section and partly in elevation of a second folder unit having functional groups.

In the folder unit in FIG. 22*b*, the forming rollers 31 and the feeding and transfer rollers 32, respectively, are driven indirectly by a shared motor 150 via a toothed belt 152. The single folding mechanism 27.1 is also driven by a separate, angle-controlled electric motor 184. The driving of the mechanism 27.1 is carried out indirectly through a belt drive 186 on, for example, the point-folding blade cylinder 145. This cylinder 145 is in drive connection with to the other folding cylinders through cylindrical gears. These electric motors 150, 184 make it possible to accurately or precisely set the speed of the driven cylinders. In groups with advance control, it is also possible to accurately or precisely set the web tension. Furthermore, the omission of PIV gears, normally used for drives of this type, provides a large reduction in the price of the unit.

Figure 23:
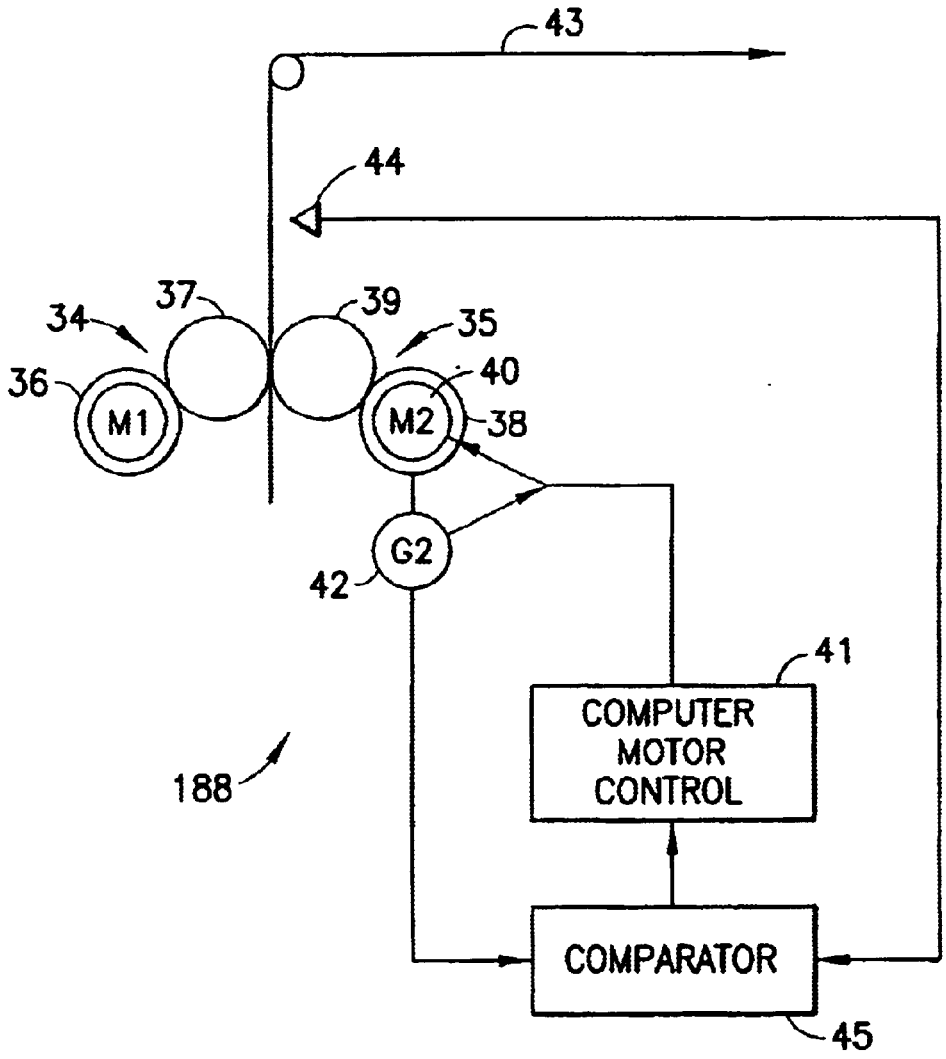
FIG. 23 is a side view of a device for ink register adjustment of printing forms of a form cylinder.

A separate electric motor, which directly drives a form cylinder, can also be used for adjusting for the ink register adjustment device. FIG. 23 shows an ink register adjustment a device 188 for use in a double printing group. The double printing group includes printing groups 34, 35. Each of these printing goups 34. 35 include a form cylinder 36, 38 and transfer cylinder 37, 39, respectively. The device is described with reference to the form cylinder 38, which carries two printing forms on its circumference. The electric motor 40 which drives the form cylinder 38 is angle-controlled by a computer motor control 41. Furthermore, a position indicator 42 of the printing group 35 and a sensor 44 which scans the register marks on the web 43 leaving the printing group 35 are connected to a comparator 45. The output of the comparator 45 is fed to the input of the computer motor control 41. The sensor 44 scans the register marks printed by the printing group 35 on the web 43 and thus detects the position of the two images printed per rotation of the form cylinder 38. Based upon the signal from the position indicator 42, the relation between the position of the form cylinder 38 and the rotation of the form cylinder 38 is determined by the comparator 45. When a printing image is staggered in the rotational direction by half the circumference of the form cylinder 38, i.e., when the printing image deviates from the register marks by half the circumference of the form cylinder 38 a compensating advance or lag of the cylinder is used to adjust the form cylinder 38 prior to printing. This is performed by the computer motor control 41 based on the output signal of the comparator 45. In this way, for example, errors relating to copying or mounting of the printing form can be compensated for. It is also possible to extend the acceleration or delay phase into this area, allowing the electric motor to be designed with lower power at the expense of sacrificing register quality.

Figure 24:
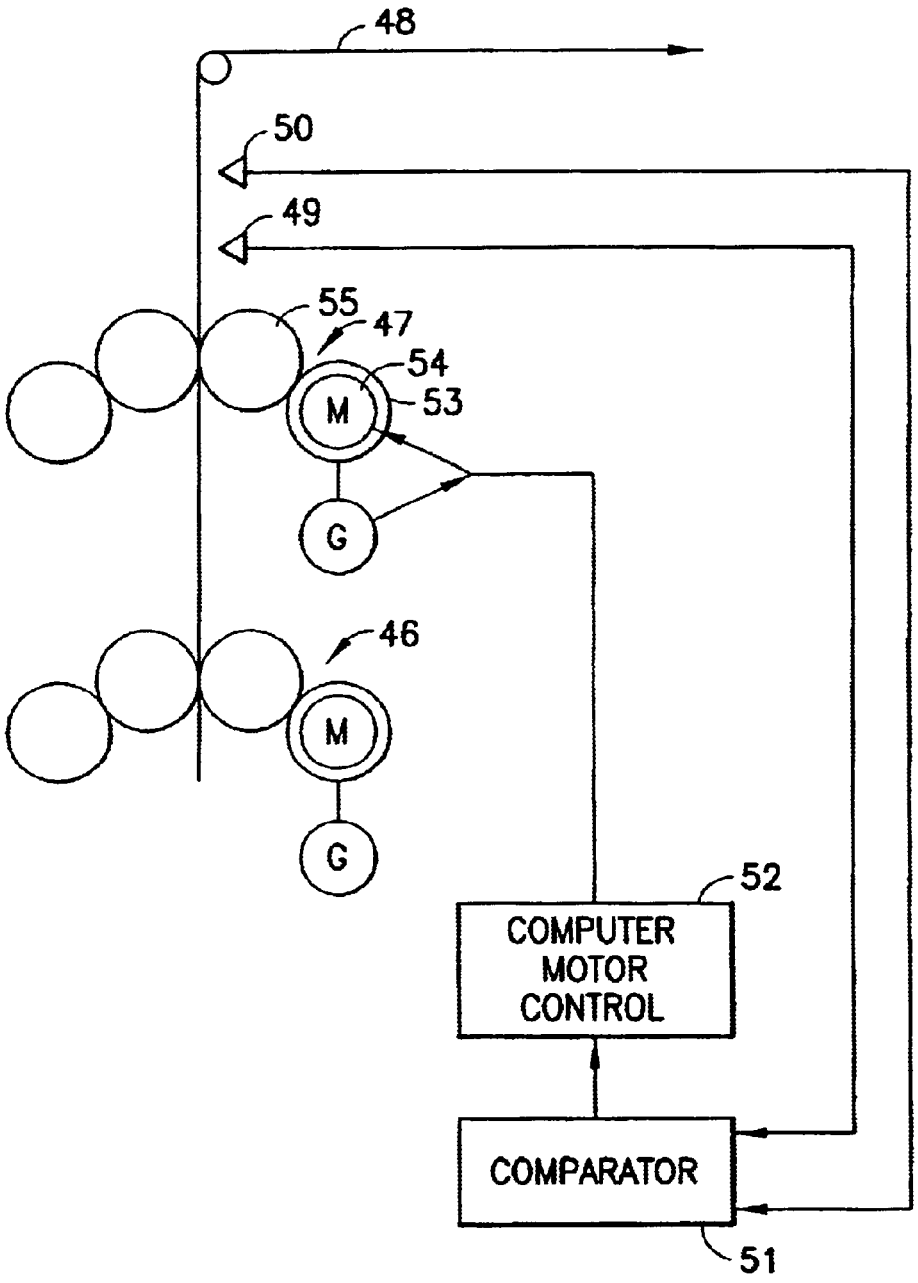
FIG. 24 is a side view of a device for ink register adjustment from printing site to printing site.

The device shown in FIG. 24 serves to control circumferential registration between two printing sites, in the situation depicted, between the printing groups 46 and 47. The register marks printed by these printing groups 46, 47 on the web 48 are scanned by the sensors 49, 50. Signals from the sensors 49, 50 are supplied to the comparator 51. The comparator 51 sends the results of the comparison to the computer motor control 52. The computer motor control 52 regulates the speed of the electric motor 54, which drives the form cylinder 53 of the printing group 47 based upon the results of the comparison. Depending on the required register modification to the printing image of the printing group 46, the electric motor 54 is operated to impart either an advance or a lag on the cylinder 53. If the transfer cylinder 55 is also driven by a separate electric motor (not shown), this motor is also corrected with respect to its speed when register correction is needed. Based upon the amount of register marks to be checked, the device is to be used as many times as appropriate to adjust the cylinders. This device is able to reduce the price of the unit by eliminating the need for expensive mechanical gears, e.g., sliding gears, to perform circumferential register adjustment of the form cylinder as was needed in traditional machines.

The use of a separate drive for all the printing groups makes possible for different paper paths to travel between different printing units without the need for additional devices for regulating the length of the paper path. For example, in the printing machine in FIG. 21*a*, the web 155 can be conducted from the printing unit 23 to either the printing unit 21 or, on the path shown by the broken line, to the printing unit 22. In keeping with the different paths, the printing groups of the printing units 21 and 22 are moved into the required positions by their respective drive motors. The computer motor control 56 of the electric motors is connected to receive a signal indicating the required cylinder positions from a computing and memory unit 57, in which the required cylinder positions are stored. Depending on the web course, the computer motor control 56 moves tie form cylinders and transfer cylinders of the unit 21 or 22 to be run through into the required positions by controlling their electric motors in accordance with the signal received from the computing and memory unit 57.

Figure 25:
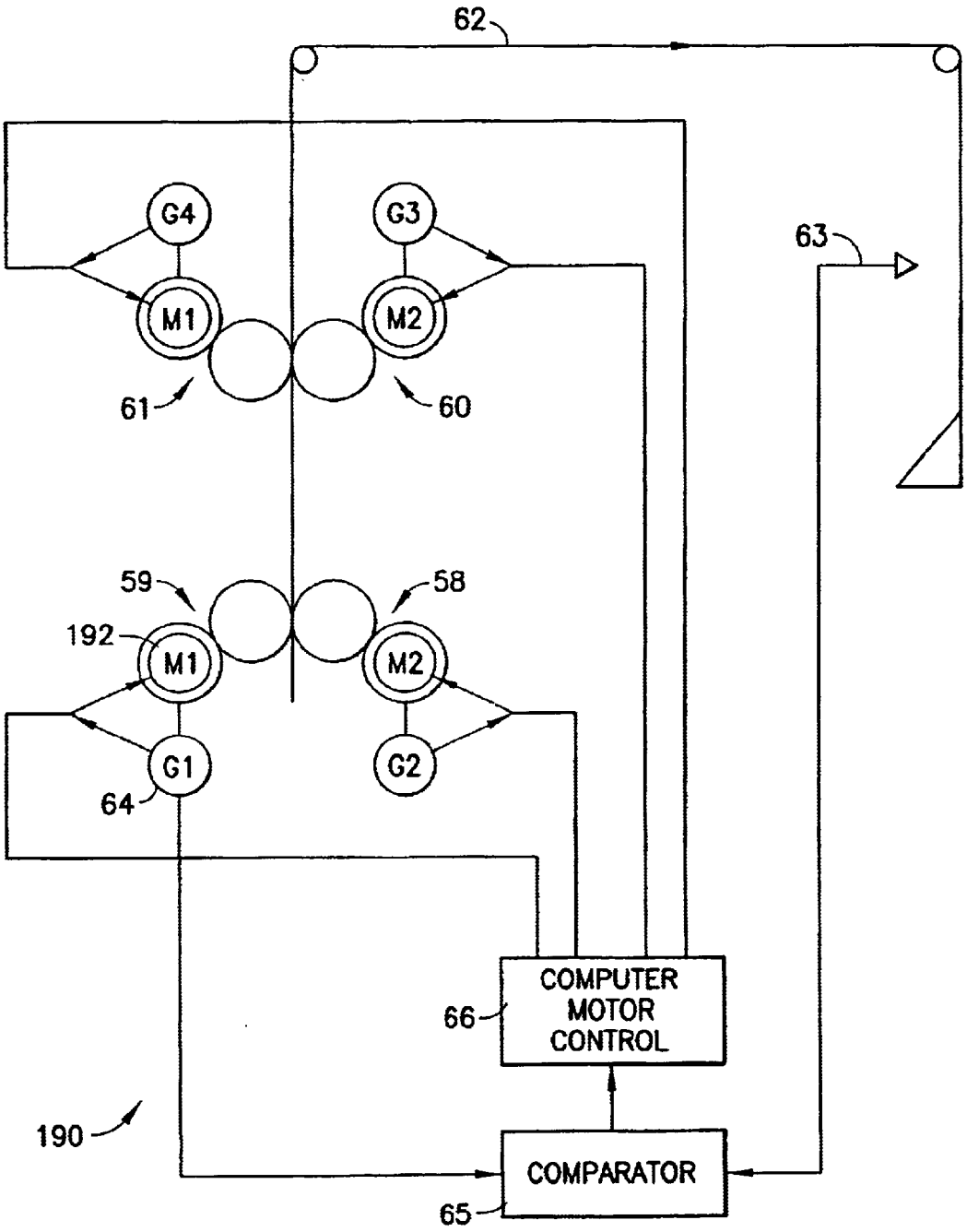
FIG. 25 is a side view of a device for cutting register adjustment.

In addition, the computing and memory unit 57 stores, the cylinder positions of the printing groups for the cutting register for each of the possible web paths. In order to set the cutting register, the required cylinder positions are sent to the computer motor control 56. The computer motor control 56 adjusts the drive motors of all printing groups printing the web 155. The cutting register for the cut in the folding mechanism 25 is thus set via the cylinder positions of all printing groups printing the web. Expensive linear register devices are no longer needed with the present devices as adjustment is automatically carried out by the computing and memory unit 57 and computer motor control 56. Length regulation of this type is now only required for the turning web. The computing and memory unit 57 which stores the cylinder positions for the cutting register can also send a signal representative of the cylinder positions for the cutting register to the computer motor control 66 as is shown in FIG. 25 and described below. This then serves both to control the cutting register and to adjust it. The computing and memory unit is shown in FIG. 21*a* and is connected in the same manner as in FIG. 25.

The separate drives of the printing groups make it possible for groups of printing machines to be assembled in various ways without connecting elements, such as synchronous shafts, couplings, gears and positioning devices which were standard in prior machines. Using a suitable control program, it is also possible for all or some of the printing units 21, 22, 23 connected to the folder unit 25 shown in FIG. 21*a* and FIG. 21*b* to be associated with a different folder unit, not shown.

FIG. 25 shows a device for a cutting register control 190. The printing groups 58 to 61 are printing on a web 62, for example. A sensor 63 scans the register mark that is being printed. The sensor 63 and the position indicator 64 of an electric motor 192 of a printing unit 59, through which the web 62 has run, preferably the first printing unit 59 the web has run through, are attached to the inputs of a comparator 65. Receiving the output of the comparator 65 is of the computer motor control 66 for the electric motors of the printing groups 58 to 61. A register error detected in the comparator 65 is compensated for by advancing or lagging the drive of the printing groups 58 to 61 printing the web 62. This is accomplished their electric motors using the computer motor control 66.

Figure 26:
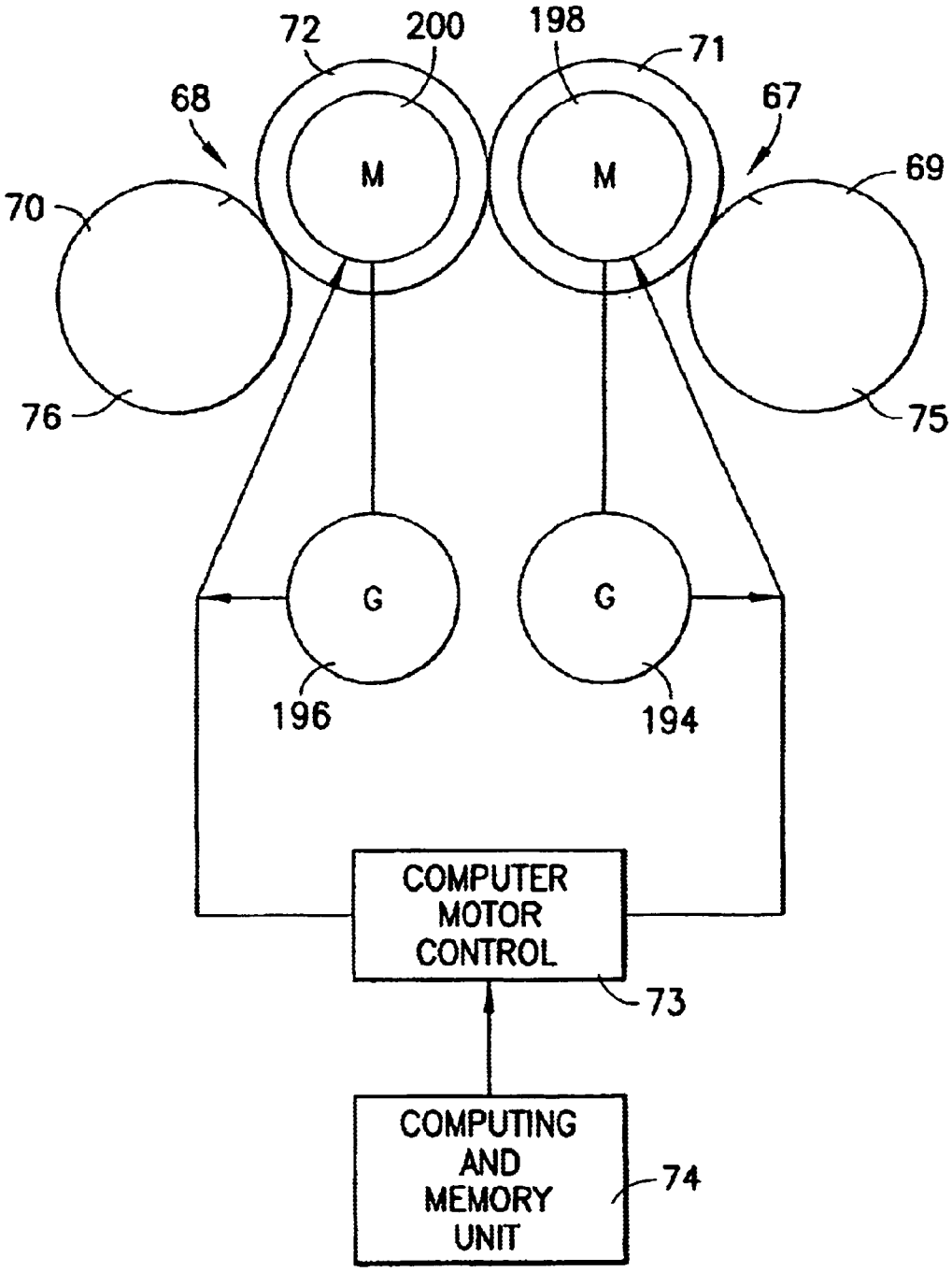
FIG. 26 is a schematic side view of a device for setting the plate changing position.

FIG. 26 shows a device used to move a form cylinder into a position suitable for performing a form change. The printing unit in this figure contains two printing groups 67, 68 each including respective form cylinders 69, 70 and transfer cylinders 71, 72. Attached to each transfer cylinder 71, 72 is a respective position control 194, 196. The drive motors 198, 200 of the printing groups 67, 68, which drive the transfer cylinders 71, 72 are connected to receive control signals from a computer motor control 73, which generates the control signals based upon signals received from a computing and memory unit 74. The cylinder positions of the form cylinders 69, 70 required for a printing-forms change are stored in the computing and memory unit 74. These positions are sent to the computer motor control 73, which controls the electric motors 198, 200 of the printing groups 67, 68 such that clamping channels 75, 76 of the form cylinders 69, 70 are moved into the form change position using the shortest path. As mentioned previously, it does not matter whether the transfer cylinder, the form cylinder or both cylinders in a printing group are driven by a drive motor. This device makes it is possible to dispense with time-consuming individual disengagement of the printing groups, the subsequent positioning of the printing groups, and their re-engagement after the printing form change as is needed in conventional machines of this type.

Figure 27:
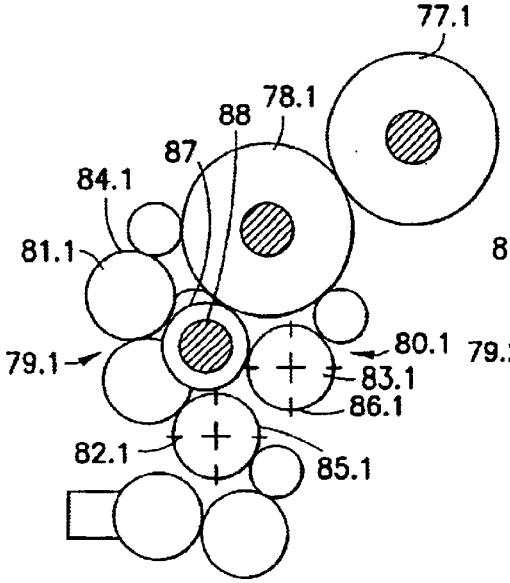
FIG. 27 is a schematic side view partly in section of a first embodiment of a drive for an inking and damping unit in accordance with the present invention.

The distribution cylinders of inking and damping units are also driven by separate drives. FIG. 27 shows a printing group including a transfer cylinder 77.1 and a form cylinder 78.1, whereby an inking unit 79.1 and a damping unit 80.1 are connected to the form cylinder 78.1. The inking unit 79.1 contains, among other items, the ink distribution cylinders 81.1 and 82.1, and the damping unit 80.1 contains the damping distribution cylinder 83.1. Each distribution cylinder 81.1, 82.1, 83.1 carries a spur gear 84.1, 85.1, 86.1, respectively, all of which are engaged with a central gear 87. The central gear 87 is driven by an angle-controlled electric motor 88. In this figure the central gear 87 is located on the rotor journal of the electric motor 88. The electric motor 88 could also be arranged next to the central gear 87 and engage it through a pinion. The electric motor 88 thus drives both of the inking distribution cylinders 81.1, 82.1 and the damping distribution cylinder 83.1 through their engagement with the central gear 87.

Figure 28:
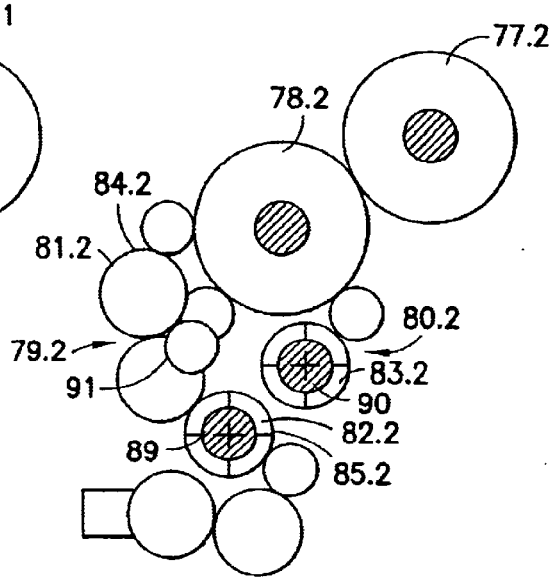
FIG. 28 is a schematic side view partly in section of a second embodiment of a drive of an inking and damping unit in accordance with the present invention.

In FIG. 28, the inking distribution cylinders 81.2 and 82.2 are driven by an angle-controlled electric motor 89. The damping distribution cylinder 83.2 of the damping unit 80.2 is driven by an angle-controlled electric motor 90. The electric motor 89 is connected to and drives the second inking distribution cylinder 82.2 directly. The second inking distribution cylinder 82.2 1to carries a spur gear 85.2 through it drives a spur gear 84.2 of the first inking distribution cylinder 81.2 through its engagement with an intermediate gear 91.

Figure 29:
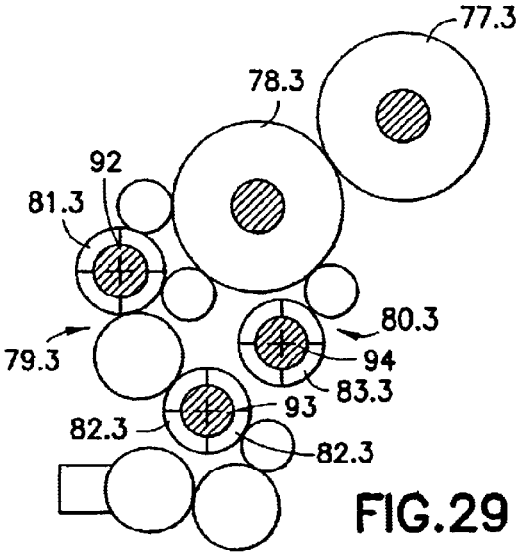
FIG. 29 is a schematic side view partly in section of a third embodiment of an inking and damping unit in accordance with the present invention.
Figure 30:
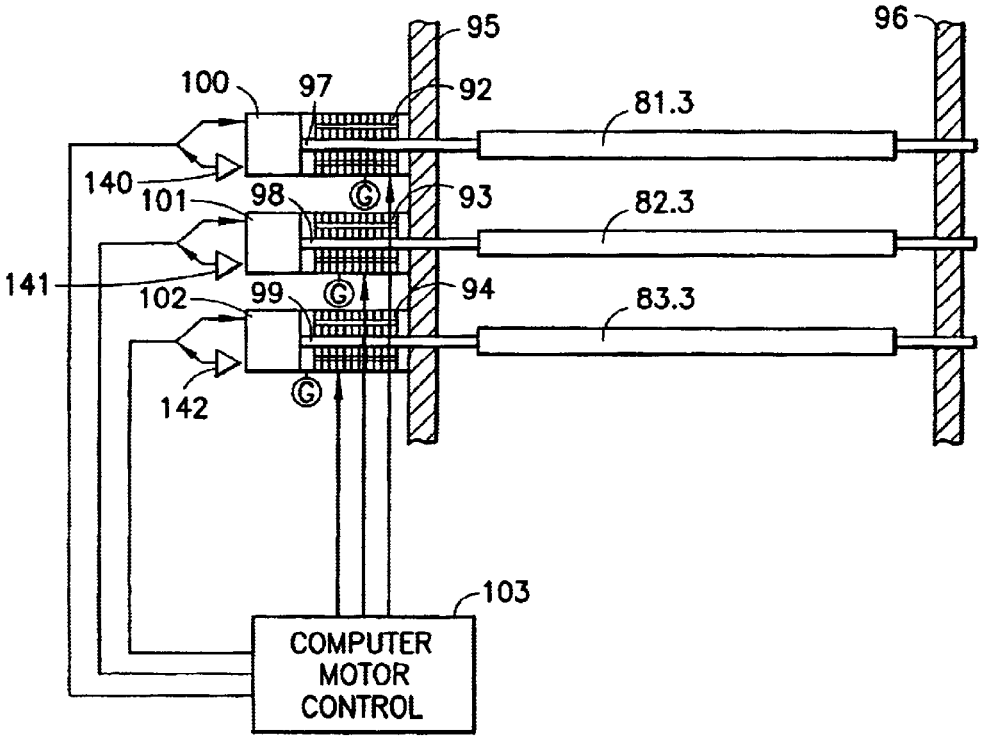
FIG. 30 is a side view partly in section and partly in elevation of the distribution cylinder shown in FIG. 29.

FIG. 29 shows a drive variant in which each inking distribution cylinder 81.3, 82.3 of the inking unit 79.3, as well as the damping distribution cylinder 83.3 of the damping unit 80.3, is driven by a respective separate, angle-controlled electric motor 92, 93, 94. All of the toothed gears used in other machines of this type are thus no longer needed when driving the inking and damning units of this device. The lateral ink and damping distribution of the machine can also be advantageously designed. FIG. 30 shows a side view of the inking and damping distribution cylinders 81.3, 82.3, 83.3 mounted in the side walls 95, 96. Linear motors 100 to 102 act on respective journals 97 to 99 of these cylinders 81.3 to 83.3 The journals 97, 98, 99 are designed as rotors for driving electric motors 92 to 94. The angle-controlled electric motors 92 to 94 are controlled by a computer motor control 103. The motor control 103 also controls the linear motors 100 to 102 using a like sequence of motions. There is a sine-shaped curve of the oscillating motion, whereby the distributor cylinders are staggered with respect to one another by 120° in phase. In this way, a mass balance is achieved. This balance stops vibrations from being stimulated at right angles to the machine axis. The target value of the axial stroke is established in a selectable manner. The instantaneous position of each of the ink distributors 81.3, 82.3, 83.3 is fed back to the motor control 103 through respective sensors 140 to 142. In addition, it is advantageous that the oscillating speed be linearly proportional to the speed of the printing machine.

Figure 31:
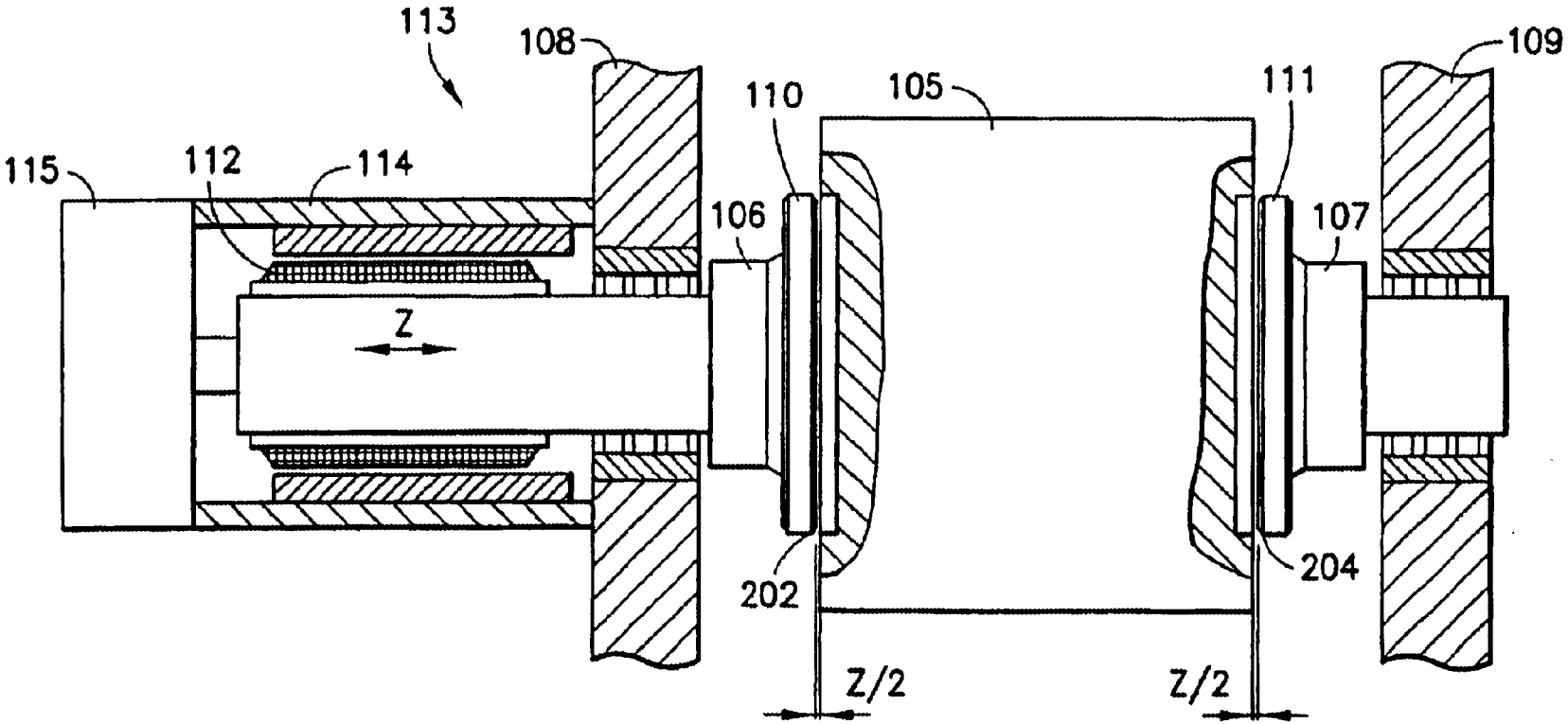
FIG. 31 is a cross sectional side view of first embodiment of an electric motor on a form cylinder in accordance with the present invention.

In order to achieve an exact drive of the cylinders, it is important for the coupling of the cylinders to the electric motor to be as rigid as possible. Structural examples of this are provided hereinbelow with respect to the remaining figures. FIG. 31 shows a form cylinder 105, which is mounted, through its journals 106, 107 in the side walls 108, 109 of the printing machine. The journals 106, 107 carry flanges 110, 111, through which they are screwed to the faces 202 204 of the cylinder body. The journal 106 is designed to act with the rotor 112 of the electric motor 113 to drive the form cylinder 105, i.e., the journal 106 carries the components of the rotor 112 of the electric motor 113 on its extended end. The stator 114 is attached to the side wall 108 of the printing machine. Furthermore, a device 115 for laterally moving the form cylinder 105 for side register adjustment acts upon the journal 106. For example, a linear motor 115 is used here for this purpose. It would also be possible to use, for example, a motor connected to a gear which is able to transform its rotational motion into a straight-lined movement. The shift amount Z of the side register is thereby designed in such a way that when the journals 106, 107 each move away from the form cylinder body 105 by a distance of Z/2, the cylinder body 105 is released and can be removed from the printing machine. A sleeve-type printing form on the form cylinder 105 can then be changed. Distribution cylinders can also be similarly designed, whereby a distributor stroke can be used for releasing the cylinder body 105 of the distribution cylinder.

Figure 32:
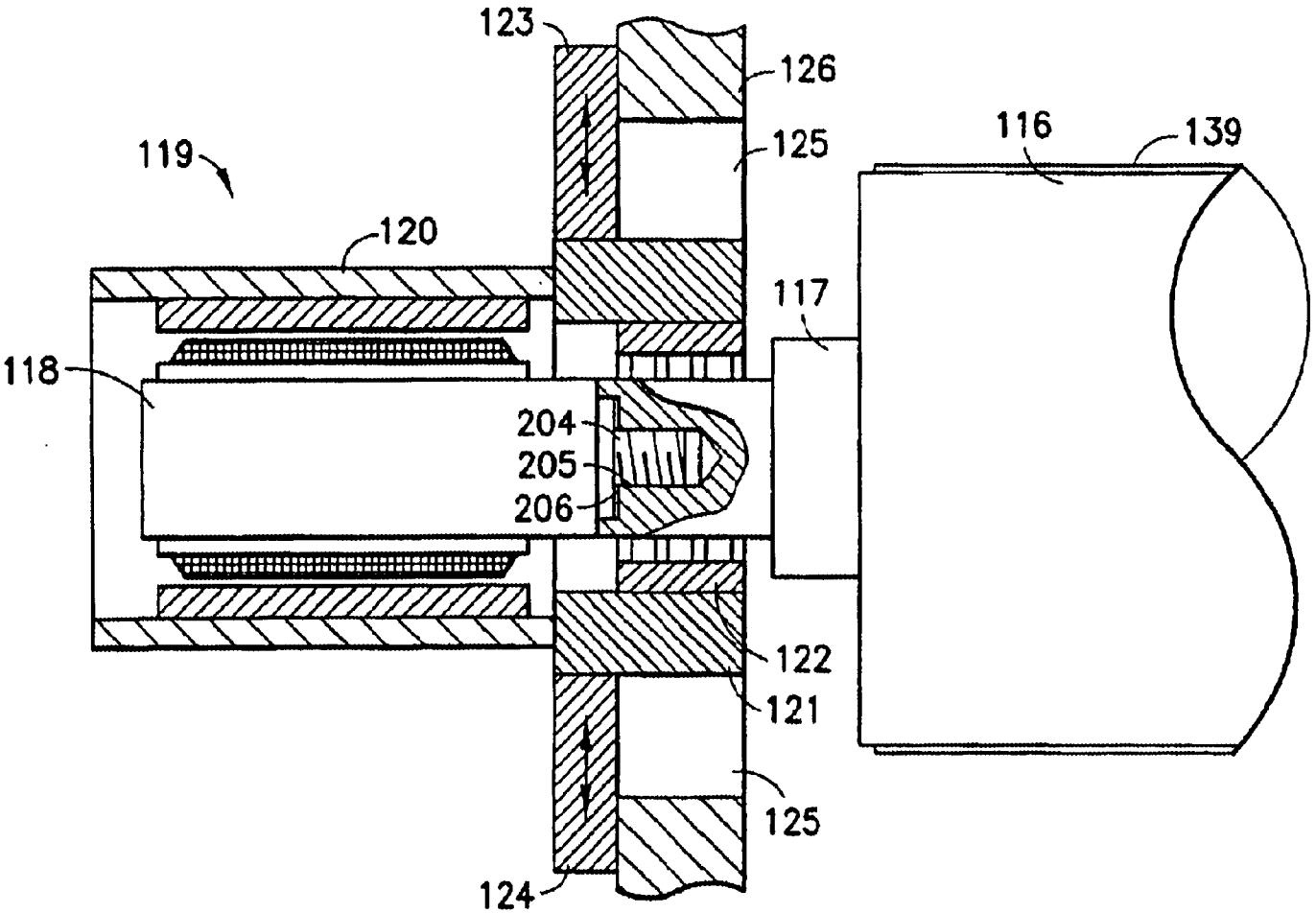
FIG. 32 is a cross sectional side view of a second embodiment of an electric motor on a form cylinder in accordance with the present invention.

FIG. 32 shows a drive-side portion of a form cylinder 116 having a journal 117. The rotor 118 of an electric motor 119 is screwed on the face 206 of the journal 117. The stator 120 of the electric motor 119, together with a bushing 12 which is connected thereto and contains the bearing 122 of the form cylinder 116 therein, is held in place by the bearing shields 123, 124. The bearing shields 123, 124 can be moved apart from one another in the direction shown by the arrows on each bearing shield 123, 124 and, in their moved-apart position, uncover an opening 125 in the side wall 126 of the printing machine. A sleeve-type printing form 139 can then pass through the uncovered opening 125 and either be placed on or removed from the form cylinder 116. The sleeve of the printing form 139 being passed through is shown by the dot-dash lines. Solutions for the design and actuation of the bearing shields 123, 124 as well as for holding the form cylinder 116 in place at its opposite end wherein it is suspended when the opening 125 is uncovered is well known in the prior art and will therefore not be discussed further. It is also possible for a transfer cylinder to be uncovered in the same manner. The design described above can be used with transfer cylinders as well as other cylinders of printing machines. In the depicted design options, it is also advantageous that the rotor and stator of the electric motor can be independently preassembled.

Figure 34:
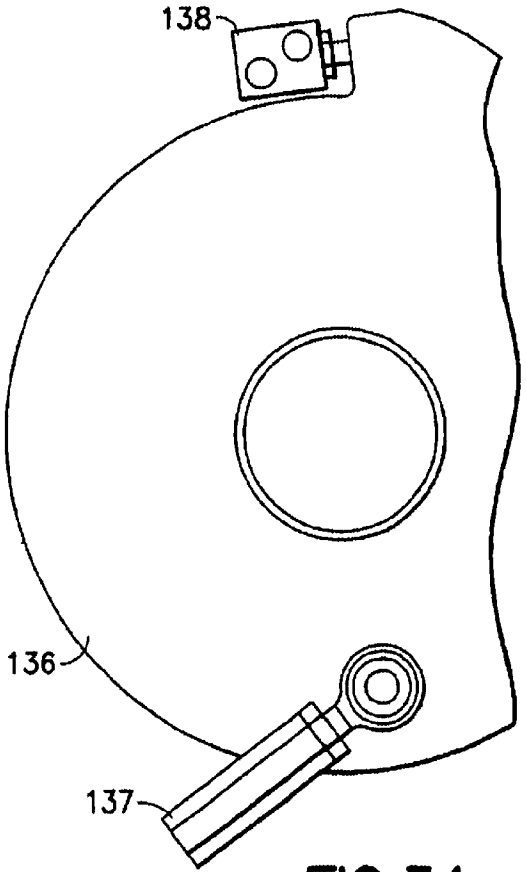
FIG. 34 is a front view of FIG. 33 in the direction of the arrow Y.
Figure 33:
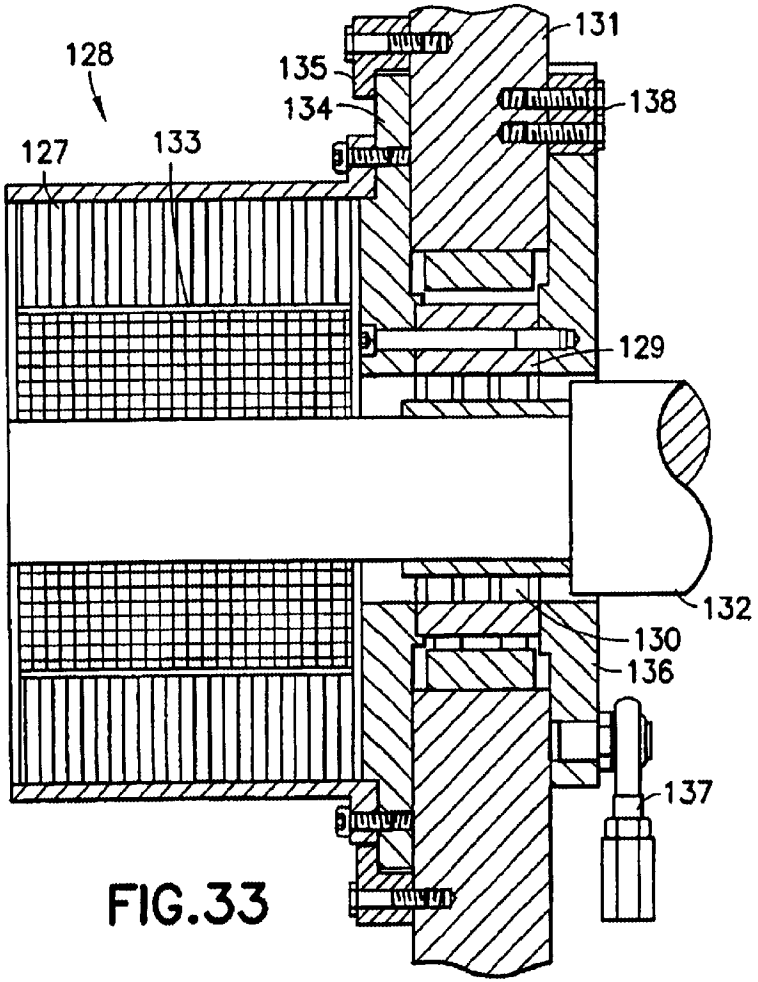
FIG. 33 is a cross sectional side view of a third embodiment of an electric motor on a form cylinder in accordance with the present invention.

FIG. 33 shows the connection of a stator 127 of an electric motor 128 to an eccentric ring 129 of a three-ring bearing 130 of a cylinder mounted in a side wall 131 by a journal. This can be, for example, either a form or transfer cylinder, of which only the journal 132 is shown in this figure. By turning the eccentric bearing ring 129, print engagement or disengagement is possible. The connection of the stator 127 permits it to travel during the engagement and disengagement movement of the journal together with the rotor 133 attached thereto. More particularly, the stator 127 is connected to a flange 134, which is screwed to the bearing ring 129. The flange 134 is axially fixed on the side wall 131 by hold-down devices 135 and absorbs the tilting moment from the weight of the stator 127. The activation of the bearing ring 129 is shown in FIG. 34. FIG. 34 is a view of FIG. 33 taken when looking in the direction of the arrow labeled "Y". The bearing ring 129 carries a nave 136, which is acted on by the print engagement and disengagement mechanism, for example, a lever 137. In the print engagement setting, the bearing ring 129 strikes a stationary and adjustable stop 138 and thus absorbs, given the corresponding rotational direction of the cylinder, the counter-moment of the stator 127. When the cylinder rotates in the other direction, the sturdily designed print engagement and disengagement mechanism 137 absorbs the counter-moment. Furthermore, the cylinder bearing is designed so as to be free of any play.

In the examples, angle-controlled electric motors are used to drive the cylinders and the functional groups. With the present invention, it is also possible to use speed-controlled or moment-controlled electric motors for drives wherein synchronism is not a main factor, such as the drive of web-pulling components and distribution cylinders. The computer motor controls can also be realized using other motor controls, depending on the individual case.

What is claimed is:

1. An offset printing machine comprising:

at least one printing unit (21–24);

a folder unit (26, 27, 27.1) having a first folding cylinder (144, 143, 145);

an angle-controlled electric motor (M);

and wherein said first folding cylinder is directly or indirectly driven by said electric motor.

2. The offset printing machine of claim 1, wherein said folding cylinder is directly driven by said electric motor.

3. The offset printing machine of claim 1, wherein said folding cylinder is a point folding blade cylinder (145) driven by said electric motor (M) via a belt drive (186).

4. The web-fed offset printing machine of claim 2, wherein said folding cylinder is driven by said electric motor via a drive connection comprising spur gears (8, 10, 19, 20).

5. A web-fed offset printing machine comprising printing units having at least one form cylinder and one transfer cylinder (1.1 to 1.5; 2.1 to 2.5); and at least one folding unit (25); and wherein, for each printing unit, at least one of said form and transfer cylinders (1.1 to 1.5; 2.1 to 2.5) has a drive connection to a separate electric motor (7), said at least one cylinder (1.1 to 1.5; 2.1 to 2.5) having one selected from the group consisting of no mechanical drive connection to a further one of said cylinders (1.1 to 1.5; 2.1 to 2.5) when said cylinder is driven directly or indirectly by a further separate electric motor (7) and a mechanical drive connection to one of said further cylinders when said further cylinder is not driven by a separate motor (1.1 to 1.5; 2.1 to 2.5);

said printing machine further comprising a length register device for setting the cutting register of a turned web, and wherein the cutting register of the web (155, 62) is set with said electric motor (7);

said printing machine further comprising a motor control system (56, 66) for said electric motor (7) of a printing group (58 to 61) that prints the web (155, 62) and having an input side; a computing and memory unit (57), connected to said input side for storing the cylinder positions for the cutting register for possible web runs in order to set the cylinder (2.1 to 2.5) of all printing groups (58 to 61) that print the web (155, 62) into a predetermined position for the respective web run, so that the cutting register relating to the cutting in said folder unit (25) can be set via the cylinder positions of all printing groups (58 to 61) taking part in the printing operation.

6. The web-fed offset printing machine of claim 5, wherein said mechanical drive connection comprises spur gears (8, 10, 19, 20).

* * * * *